United States Patent [19]

Rutishauser

[11] 4,240,622

[45] Dec. 23, 1980

[54] MECHANISM FOR TRANSPORTING SHEETLIKE RECORDING CARRIERS

[76] Inventor: Albert Rutishauser, Rutihofstrasse 38, 8713 Werkion, Switzerland

[21] Appl. No.: 30,380

[22] Filed: Apr. 16, 1979

[30] Foreign Application Priority Data

Apr. 18, 1978 [CH] Switzerland ..... 41257/78

[51] Int. Cl.[3] ..... B65H 1/12

[52] U.S. Cl. ..... 271/126; 271/161

[58] Field of Search ..... 271/126, 127, 145, 147, 271/148, 157, 160, 161, 167, 169–171

[56] References Cited

U.S. PATENT DOCUMENTS

| | | | |
|---|---|---|---|
| 3,511,496 | 5/1970 | Zoglmann | 271/161 X |
| 3,768,805 | 10/1973 | Kuksa | 271/126 |
| 3,807,725 | 4/1974 | Bookless | 271/170 X |
| 4,017,181 | 4/1977 | Komaba et al. | 271/127 X |

*Primary Examiner*—Robert W. Saifer

*Attorney, Agent, or Firm*—Cushman, Darby & Cushman

[57] ABSTRACT

A sheet transporting magazine for automatic typewriters or the like with a three point bar structure for arching a stack of sheets in the conveyance direction while disposed in the magazine to prevent the sheets from canting laterally in the magazine.

11 Claims, 3 Drawing Figures

MECHANISM FOR TRANSPORTING SHEETLIKE RECORDING CARRIERS

RELATED APPLICATION

Figure 1:
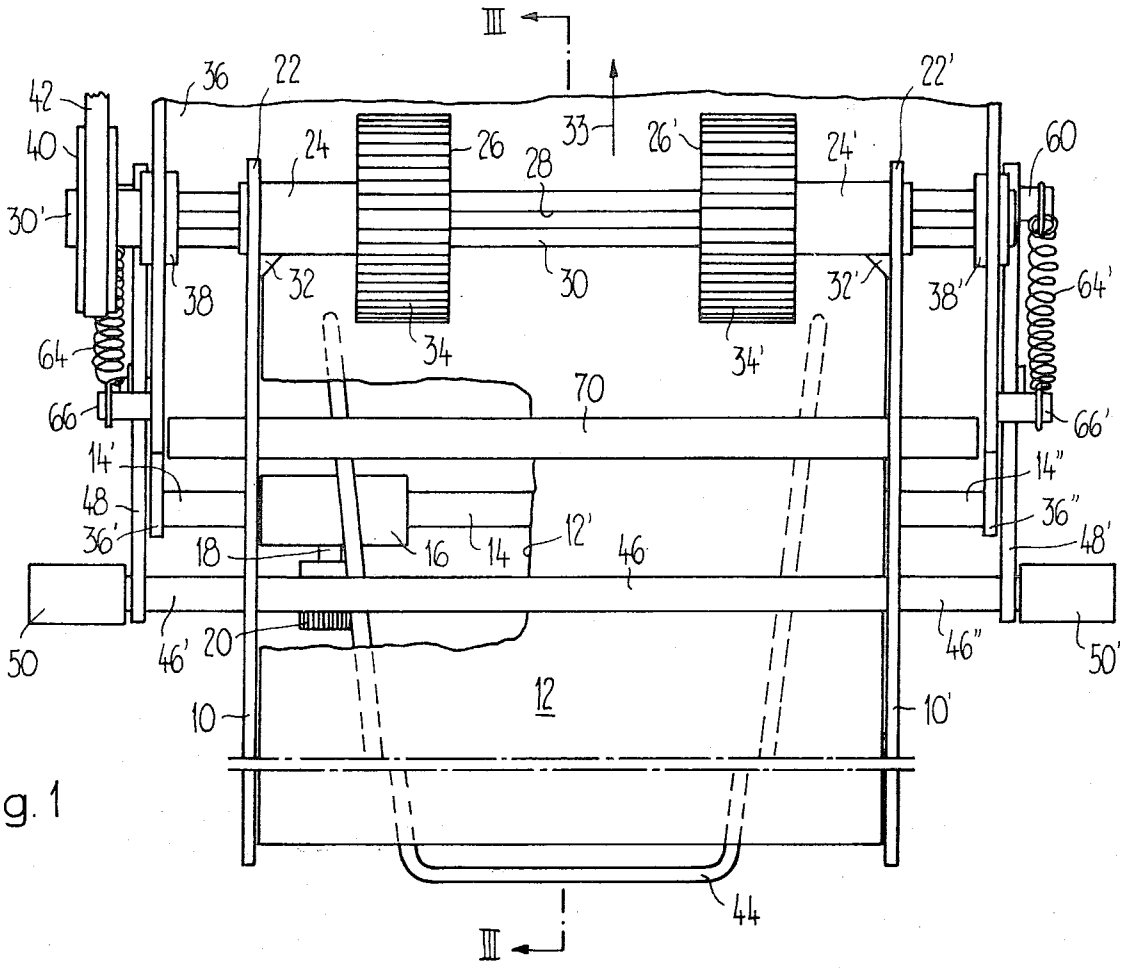

This application is related to the copending application of Rutishauser et al, Ser. No. 4,925 filed Jan. 19, 1979.

PREAMBLE

The invention relates to a mechanism for transporting sheet-shaped recording carriers.

Such a mechanism serves for feeding sheet-shaped recording carriers, stacked in the magazine, for example sheets of forms, to an automatic writing or multiplying device, especially to a typewriter or accounting machine. Customarily the sheets are stacked lying flat in the magazine and are removed from the stack by two driving rollers disposed on a shaft at a mutual distance, and are fed to a typewriter. Separating corners serve for separating the sheets, which must be skipped by the sheet, which at any time must be taken from the stack with its corners lying forward, in the direction of conveyance. As a result of irregularities which cannot be avoided, for example in the friction between the sheet that is to be removed and the driving rollers, it is not always sure during skipping of the separating corners, that the conveyed sheet is transported in a straight line. As a result, it happens that sheets will be canting laterally and thus disturb the operation.

Therefore, the invention is based on the task of creating a mechanism of the initially stated type to avoid any canting of the transported sheets.

The task set is solved by increasing the rigidity of the recording carriers by arching, so that they are no longer able of canting within the lateral guide elements.

In a preferred embodiment, the arching is brought about compulsorily and is absolutely assured in the magazine up to the last sheet.

In a further preferred embodiment, the seating element may be a pressure bar, always held at its opposite ends by pivotally mounted arms. The pivotal arrangement is advantageous in order to lift the bar for the purpose of inserting a new stack. The pivoted arms may be parts of levers, the opposite ends of which are developed for engagement at their ends with a contact bar, which stands in the direction of the driving roller under spring load. This results in an advantageous connection, because upon lifting the pressure bar, the contact bar is removed at the same time from the driving roller, in order to permit the insertion of the new stack.

Figure 2:
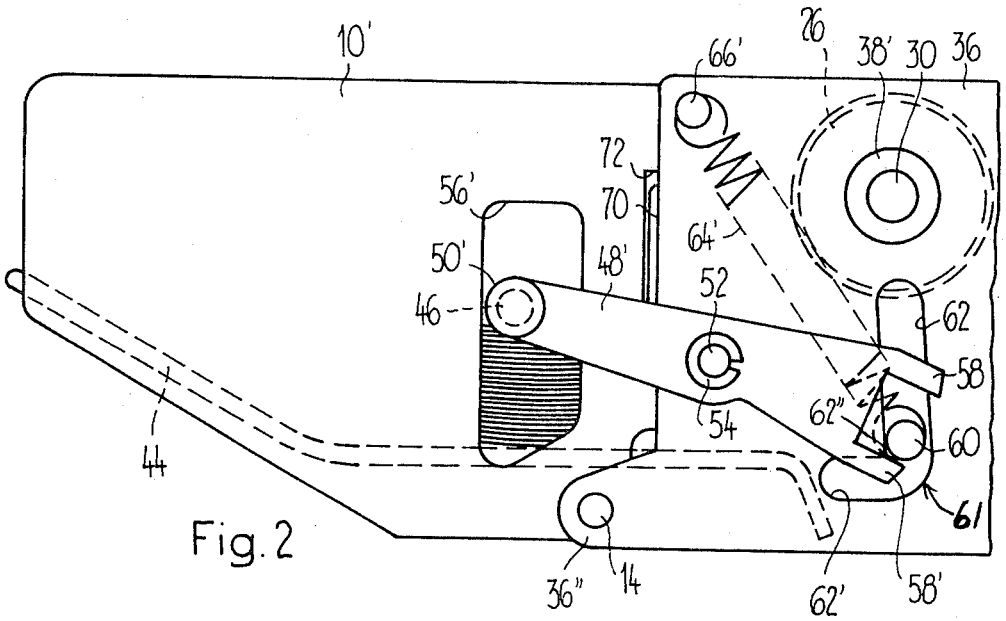
Figure 3:
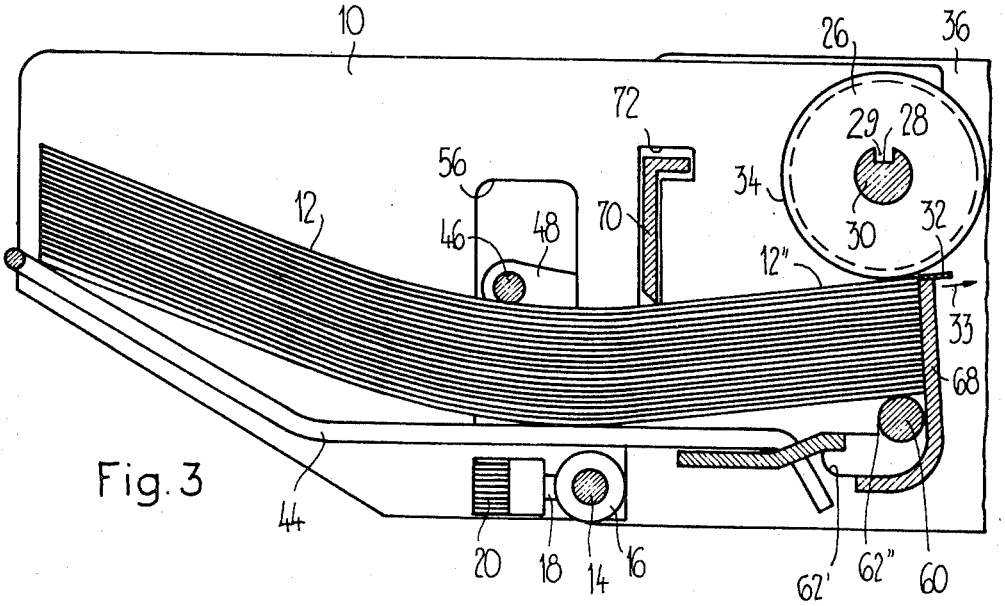

An embodiment of the object of the invention is explained in more detail on the basis of the drawing, in which:

FIG. 1 shows a mechanism for the transportation of sheet-shaped recording carriers in top view, FIG. 2 shows a side view of the mechanism, and FIG. 3 a cut along the line III—III of FIG. 1.

According to FIG. 1, between two stop plates 10 and 10', there is a stack of sheet-shaped recording carriers 12, for example in the form of sheets of forms. The stop plates 10 and 10' are laterally adjustable in order to adapt them to the pertinent width of the sheets of forms used. In order to be able to explain the elements required for adjusting at least the left-hand support plate 10, the stack 12 has been presented broken away at 12'. The left-hand support plate is rigidly connected with a guide bushing 16, disposed longitudinally shiftably on a guide bar 14. In order to be able to arrest the guide bushing 16 and thus the support plate 10 in a suitable position, a clamping screw 18 with a knurled head 20 has been inserted into a threaded bore in the guide bushing 16.

A bushing 24 is rotatably fixed to support plate 10, adjacent to the inner end 22 thereof but is not axially shiftably in relation to the support plate. The bushing 24 is fixed in rotation with a carrier roller 26 and together are pushed onto a driving shaft 30. The bushing 24 has a key projection 29 (FIG. 3), which engages axially shiftably with a key track 28 of the driving shaft 30, and is hence torsion proof. As a result of the mechanism described, the bushing 24, and thus also the driving roller 26, are shifted axially during the lateral adjustment of the support plate 10 on the driving shaft 30, so that the distance of the driving roller 26 from the support plate 10 always remains constant, independently of their adjusted position. Thus a constant distance will also be maintained between the driving roller 26 and a singling corner 32, which is firmly connected with the support plate 10 and which must always skip the topmost sheet of the stack 12, during conveyance by the driving roller 26 in the direction of the conveyance 33, and thus assures a perfect functioning in case of removal or separation.

The second, opposite driving roller 26' is homologously, but in the same manner, connected with the support plate 10' as the driving roller 26 with the support plate 10. The right-hand support plate 10' may also be shifted by a bushing (not shown) on guide bar 14 and may be arrested by means of a clamping screw (not shown). The right-hand support plate 10' is also connected with a singling corner 32'. The driving rollers 26 and 26' have toothed rubber tires 34 or 34', in order to strengthen the grip.

The driving shaft 30 is mounted in bushings 38 and 38' which are disposed in a frame or chassis 36. A toothed belt pulley 40 is disposed on one end 30' of the driving shaft 30, around which a toothed belt 42 is looped. The driving rollers 26 and 26' may be driven rotatingly by driving elements (not shown) by way of this toothed belt 42.

The guide bar 14 is rigidly attached with its ends 14' and 14'' in sidewalls 36' and 36'' of the chassis 36.

The stack 12 rests at least partially on a stirrup 44. A bar 46 is mounted at its ends 46' and 46'' in a respective lever 48 or 48', and has handles 50 and 50' at its opposite ends exterior to levers 48 and 48'.

FIG. 2 shows the mechanism of FIG. 1, viewed from the right-hand side. From this illustration the arrangement of the lever 48' particularly becomes clear, which is mounted movably around a pivot 52, attached on the chassis 36, and is secured axially by a disc such as a C-washer or clip 54. The bar 46, held in the levers 48 and 48' reaches through windows 56 and 56' in support plates 10 and 10'. The end of the lever 48', opposite the bar 46 is developed in the shape of a fork and has two prongs 58 and 58'. Between prongs 58 and 58', there is the end of a contact bar 60, which extends between levers 48 and 48' and is guided at each of its ends by an angular of L-shaped slit 61 disposed in each sidewall of chassis 36. Slits 61 have a guide leg portion 62 and a stop or foot portion 62'. Spiral springs 64 and 64' continuously engage the opposite ends of contact bar 60 and are suspended from pegs 66, 66' to load or pull the contact bar 60 up into the legs 62 of the angular slits 61 in the direction of the driving rollers 26 and 26'.

From FIG. 3 it is clear, that the forward end 12'' of stack 12 of sheet-shaped recording carriers is pressed by contact bar 60 against the toothed rubber tires 34, 34' of the driving rollers 26, 26'. The stack 12 fits in the direction of conveyance 33, with its front side against a stop plate 68, which preferably extends from sidewall to sidewall to which it is connected so as to abut the outside forward and bottom edges of slits 61 and is correspondingly angular.

An angular rail 70 (see also FIG. 1), extends between and through sidewalls 36' and 36'' of the chassis 36 and is guided therein by angularly-shaped slits 72, with a clearance of a few millimeters, perpendicularly to stack 12. This angular rail 70, resilient inside the slit 72, serves to limit the height of the stack 12 of recording carriers to be inserted.

In order to be able to insert a stack of recording carriers into the magazine, formed by the elements 10, 10', 44, 60 and 68, pressure bar 46 must be raised by handles 50 and 50'. At the same time, the levers 48 and 48' seen from the view of FIGS. 2 and 3 are pivoted clockwise, so that prongs 58 force the contact bar 60 downwards, until the latter is pushed past the corners or edges 62'' of slits 61 and is afterward pulled by the action of the springs 64 and 64' to the rearward end of feet 62' of the angular shaped slits 61. Thus the contact bar 60 is arrested in its position away from the driving rollers 26 and 26', so that a stack 12 of recording carriers may be pushed unimpeded in this inserting position by the bar 46, since the levers 48 and 48' fit with their prongs 58' against the ends of the contact bar 60 and, as a result, hold the bar 46 high. After the insertion of the stack 12, the bar 46 is manually pressed down by its handles 50 and 50', so that the contact bar 60 must again overcome the slit corners or edges 62'' and afterward is pulled upward in legs 62 by the action of springs 64 and 64' to press the end 12'' of the stack 12 against the driving rollers 26 and 26''.

The stack 12 is lifted at the rearward end by the stirrup 44 being angulated upward, and at the forward end by the contact bar 60 being pulled upward. Bar 46 resting transversely in the middle area on the stack 12 guarantees that all sheets of the stack are arched in the rearward-forward or conveyance direction in a concave sense looking down from the top. Because of the arching the stiffness of the sheets of the stack 12 is increased, and thus any lateral canting during transportation and especially during skipping of the singling corners 32 and 32', is avoided. Furthermore, always constant conditions are created as a result of the distance of the driving rollers 26 and 26' from the singling corners 32 and 32' always remaining the same, independently of the adjusting position of the stop plates 10 and 10'.

The contact bar 60, drawn at both its ends independently of one another against the driving rollers 26 and 26', makes possible a contact pressure, distributed uniformly to both driving rollers 26 and 26', even in case of laterally variable thickness of the stack 12 because for example of an irregular position of the individual sheets.

Even in case of a decreasing stack 12, the bar 46 always rests on the stack and insures its arching.

What is claimed is:

1. In transportation mechanism for sheetlike recording carriers including a magazine having lateral guide elements for sheets to be stacked, a singling mechanism and driving roller means for conveying only one sheet at a time from the magazine, the improvement comprising means for holding stacked sheets arched in the direction of conveyance to give said sheets stiffness in lateral direction and including physical means movably substantially perpendicularly to said lateral and conveyance directions for pushing on the stacked sheets in the middle area thereof to to cause the stacked sheets to be arched as aforesaid.

2. A mechanism as in claim 1 in which said driving roller means is disposed above said magazine and characterized in that said holding means includes seating elements for supporting the stacked sheets adjacent the longitudinal ends of said magazine, and for maintaining the uppermost sheet of the stacked sheeets in contact with the driving roller means, and said physical means includes means for exerting a force directed downwards on the stacked sheets in the middle area thereof.

3. A mechanism as in claim 1 or claim 2, characterized in that said physical means includes a bar which presses downward in said middle area of said stacked sheets, said bar having pivotally mounted arms at its ends.

4. A mechanism as in claim 3, characterized in that said driving roller means is mounted rigidly in radial direction, said seating elements including a contact bar, said arms being parts of pivoted levers having further arms opposite their pivot developed for engagement at their ends with said contact bar and means spring loading said contact bar in the direction of the driving roller means.

5. A mechanism as in claim 4, including a frame having sidewalls, said ends of the opposite arms of the levers being developed fork shaped and said contact bar being guided at opposite ends in guide slits which extend in said sidewalls about radially in relation to the driving roller means.

6. A mechanism as in claim 5, characterized in that the guide slits at their ends removed from the driving roller means are extended by respective stop slits for catching the contact bar.

7. In transportation mechanisms for sheetlike recording carriers including a magazine having lateral guide elements for sheets to be stacked, a singling mechanism and driving roller means for conveying only one sheet at a time from a magazine, the improvement comprising:

means for holding stacked sheets arched in the direction of conveyance, wherein said driving roller means includes a shaft and a plurality of driving rollers disposed torsion proof on said shaft, said lateral guide elements having laterally adjustable stop plates each of which is connected with one of said driving rollers by means of a bushing and is adjustable together with the latter, and said singling mechanism has a singling corner connected with each stop plate.

8. A mechanism as in claim 7, including bushings and wherein said shaft has at least one key track and key projections connected with said bushings engage with sliding fit in said track.

9. A mechanism as in claim 7, including a guide bar and a guide bushing disposed stopably and shiftably on said guide bar, said stop plates being fixed to said guide bushing.

10. In transportation mechanisms for sheetlike recording carriers including a magazine having lateral guide elements for sheets to be stacked, a singling mechanism and driving roller means for conveying only one sheet at a time from the magazine, the improvement comprising:

means for holding stacked sheets arched in the direction of conveyance, said driving roller means being disposed above said magazine, said holding means including seating elements for supporting the stacked sheets adjacent the longitudinal ends of said magazine and for maintaining the uppermost sheet of the stacked sheets in contact with the driving roller means, and means for exerting a force directed downwards on the stacked sheets in the middle area thereof, said force exerting means including a bar which presses downward in said middle area of said stacked sheets, said bar having pivotally mounted arms at its ends.

11. A mechanism as in claim 1, 2, 7 or 10 characterized in that a stack-limiting element extends transversely across the magazine and limits the height of a stack of sheets to be inserted.

* * * * *

UNITED STATES PATENT AND TRADEMARK OFFICE

CERTIFICATE OF CORRECTION

PATENT NO. : 4,240,622

DATED : December 23, 1980

INVENTOR(S) : Albert RUTISHAUSER

It is certified that error appears in the above—identified patent and that said Letters Patent is hereby corrected as shown below:

In the heading

The patent should be read as containing the following information:

[76] Inventor: Albert RUTISHAUSER, Rutihofstrasse 38, 8713 Uerikon, Switzerland

Signed and Sealed this

*Sixteenth* Day of *June 1981*

[SEAL]

*Attest:*

RENE D. TEGTMEYER

*Attesting Officer* *Acting Commissioner of Patents and Trademarks*